United States Patent [19]

Karl

[11] 4,413,873

[45] Nov. 8, 1983

[54] ELECTRICAL TAB RECEPTACLE

[75] Inventor: Walter Karl, Lugarno, Australia

[73] Assignee: Utilux Pty. Ltd., Australia

[21] Appl. No.: 298,341

[22] Filed: Aug. 31, 1981

[30] Foreign Application Priority Data

Sep. 17, 1980 [AU] Australia ..... PE 5606

[51] Int. Cl.[3] ..... H01R 11/22

[52] U.S. Cl. ..... 339/74 R; 339/258 F

[58] Field of Search ..... 339/74 R, 256 SP, 258 F, 339/258 S

[56] References Cited

U.S. PATENT DOCUMENTS

| | | | |
|---|---|---|---|
| 3,976,348 | 8/1976 | Simmons | 339/74 R |
| 4,220,388 | 9/1980 | Dechelette | 339/74 R |

FOREIGN PATENT DOCUMENTS

| | | | |
|---|---|---|---|
| 2853512 | 6/1979 | Fed. Rep. of Germany | 339/74 R |
| 1597164 | 9/1981 | United Kingdom | 339/74 R |

*Primary Examiner*—John McQuade
*Assistant Examiner*—Paula Austin
*Attorney, Agent, or Firm*—Ostrolenk, Faber, Gerb & Soffen

[57] ABSTRACT

An electrical tab receptacle has a rearward portion for connection to an electrical conductor and a forward portion of channel shape formed by a base, upstanding side walls and a turned in portion of the side walls providing free edge portions in spaced confronting relationship with the base whereby the complementary tab is adapted to be received between the free edge portions and the base to form a connection; the tab receptacle is characterized by a resiliently displaceable engagement member extending from the side of the receptacle with a portion of the engagement member extending between the turned in side walls to provide an engagement element for engaging in latching relationship with the complementary tab to retain it in position, the engagement member further providing a release portion located outside the channel shaped portion for receiving a displacement force for disengaging the engagement element from the tab, the engagement element being biased into its latching position. An insulating housing may be provided for the receptacle and the housing may be slidable longitudinally such that a cam surface thereof engages the release portion to disengage the engagement element from the tab to permit its removal.

12 Claims, 6 Drawing Figures

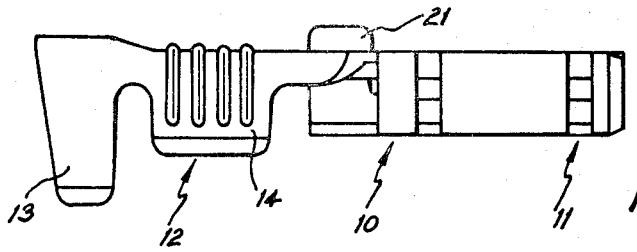
FIG. 1
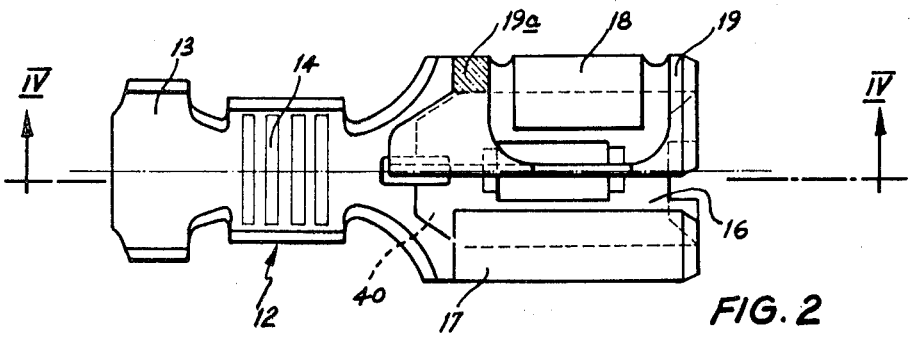
FIG. 2
FIG. 3
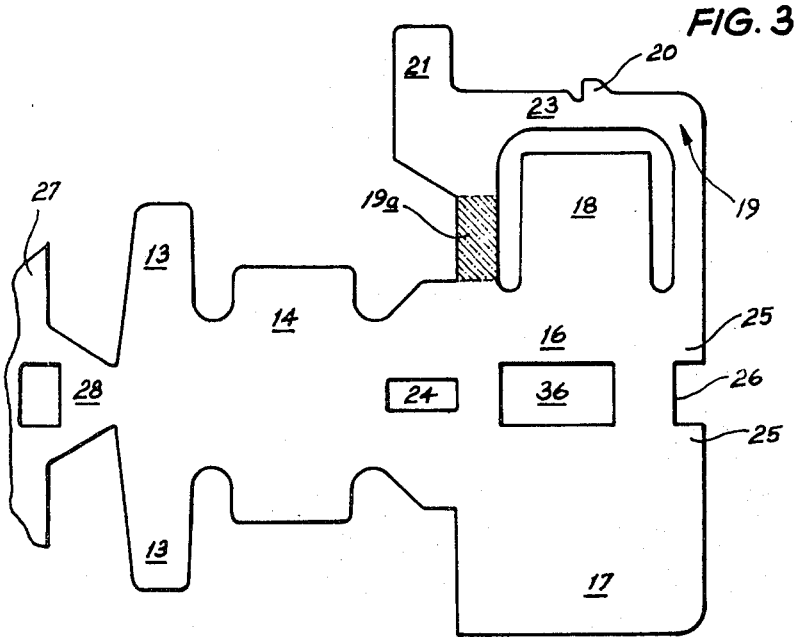

ELECTRICAL TAB RECEPTACLE

FIELD OF THE INVENTION

The present invention relates to electrical tab receptacles. These tab receptacles may be releasably engageable with a complementary tab.

BACKGROUND TO THE INVENTION

Examples of prior art connectors in the field of the present invention are those described in West German Pat. No. 2,853,512; U.K. Pat. No. 1,597,164; U.S. Pat. No. 4,220,388 and U.S. Pat. No. 3,976,348 and the related art referred to therein. In the past such receptacles and tab connectors have been widely used in electrical wiring in such industries as the automotive industry and in the consumer goods field. In some applications, the engaged receptacle and tab can be exposed and in other applications the combination may be mounted in an insulating housing either singly, or alternatively a group of receptacles and a complementary group of tabs can be interconnected in a multiple housing connector.

An important requirement is to provide an effective electrical connection which is reliable in terms of providing a good quality electrical connection as well as providing a good mechanical connection resistant to vibration or mishandling. However, in many applications it is important that the receptacle and tab can be disconnected when required without undue difficulty. At the same time it is desirable for the connectors to be manufactured at low cost.

OBJECT OF THE INVENTION

The present invention concerns a tab receptacle, the invention being directed towards providing a useful alternative to known receptacles and/or to providing useful developments in the field of tab receptacles.

SUMMARY OF THE INVENTION

According to the present invention, there is provided (a) an electrical tab receptacle integrally formed from sheet metal and comprising a forward portion and a rearward portion, (b) the rearward portion being adapted to be connected to an electrical conductor and the forward portion having a generally channel-shaped receptacle portion for engaging in mating relationship with a complementary tab, (c) the receptacle portion having a base and upstanding side walls which are turned in so as to have free edge portions in spaced confronting relation with the base, the arrangement being such that the tab is adapted to be received between said free edge portions and the base to form a connection, and characterised by (d) the tab receptacle further comprising a resiliently displaceable engagement member extending from a side of the receptacle portion and a portion of the engagement member extending between the turned in portions of the side walls in a direction towards the base to provide an engagement element positioned for and having means for engaging in latching engagement with a corresponding portion of the complementary tab, (e) the engagement member having a release portion located outside the channel-shaped receptacle portion for receiving a displacement force to move the engagement element in a direction away from the base and towards the turned in portions of the side walls to permit disengagement of the engagement element from the complementary tab, and (f) the engagement element being biased to its latching position.

Preferably, the engagement member is connected to and extends from one side of the base at a position adjacent to that from which one of the side walls extends.

Most preferably the engagement member has the release portion in the form of a projection which extends through the receptacle to terminate on the side remote from the turned in side walls and at a location to the rearward end of the zone occupied by the tab when inserted. Release is simply effected by depression of the release portion. Furthermore, the release portion can provide advantageously a limit stop for limiting insertion of the tab, thereby ensuring that the tab is correctly positioned for latching engagement with the latching element.

In an important embodiment of the invention, the engagement member is generally "h-shaped" when flat.

In one embodiment, the engagement member has base legs extending from the side of the base at respective ends of one of the side walls, the engagement element being formed in the cross arm of the "h" and the top leg of the "h" providing the release portion, the h-shaped element being bent over through approximately 180°.

In a preferred embodiment, it is advantageous to provide the turned in side wall around which the "h-shaped" member is located to be of shorter length than the opposite side wall, the opposite side wall having approximately the same length as the overall longitudinal span from leg to leg of the "h-shaped" member.

Most preferably, the "h-shaped" member has its top leg forming the release portion and this is offset relative to the adjacent base leg towards the rearward end of the receptacle so as to form a stop for the tab just beyond the rearward limit of the turned in side walls.

In a second embodiment, the bottom portion of the "left leg" of the "h-shaped" engagement number is omitted and only the other leg connects the member to the base.

Embodiments of the invention can be manufactured economically and efficiently with relatively low use of sheet material from which the receptacles are stamped out and bent. Furthermore, an important advantage is that since the electrical connection is between the free edge portions of the turned in side walls and the base, a firm fit providing good electrical connection despite any mildly corrosive conditions can easily be provided. The engagement element provides a latching retention feature and although it may aid electrical connection, this element is fundamentally a mechanical latch.

Furthermore, the invention may be embodied in combination with an insulating housing formed with means for co-operating with the receptacle to retain the receptacle in normal use within the housing, the housing being of generally tubular form with one end adapted to receive an electrical conductor and the opposite end the complementary tab.

Most preferably, the base of the receptacle has an aperture which is best placed at the region of the longitudinal center line and the insulated housing has an inwardly directed projection arranged to snap fit into the aperture in the base to retain the receptacle.

It is best to form the aperture as a rectangular aperture with the ends of the aperture formed by inclined walls projecting below the general plane of the base in its portion surrounding the aperture, but not extending below a plane containing the lowermost extremity provided in the region of the sides of the base and/or the bottom of the side walls. Thus the housing may have a flat internal surface supporting the lowermost portions of the receptacle in its channel shaped region with a central part of the base being in a general plane spaced above this flat surface of the housing with the projection on the interior of the housing being a snap fit into the aperture in the base, the top of the projection being intermediate the upper and lower surfaces of the central region of the base.

In the most preferred form of the invention, the housing is constructed so that the projection has a longitudinal extent less than the longitudinal length of the aperture in the base of the receptacle thereby permitting relative longitudinal motion between the housing and receptacle, the housing furthermore having an interior cam-like surface engageable with the release portion of the receptacle so that upon manual displacement of the housing relative to the receptacle against the resilient forces of the engagement member, the cam surface engages and displaces to move the release member to permit withdrawal of a tab.

BRIEF DESCRIPTION OF THE DRAWINGS

For the purpose of exemplification only, embodiments of the invention will now be described with reference to the accompanying drawings, of which:

FIG. 1 is an inverted side elevation of a receptacle embodying the invention;

FIG. 2 is a plan view of the receptacle of FIG. 1 but showing, in chain dotted lines, a portion which may be omitted leaving a second embodiment of the invention;

FIG. 3 is a view showing a blank when cut from a flat metal sheet prior to bending to form the receptacle of FIGS. 1 and 2;

DETAILED DESCRIPTION OF THE DRAWINGS

The drawings illustrate a receptacle 10 integrally formed from sheet metal and comprising a forward portion 11 for connection to a complementary tab and a rearward portion 12 for connection to an electrical conductor.

Figure 6:
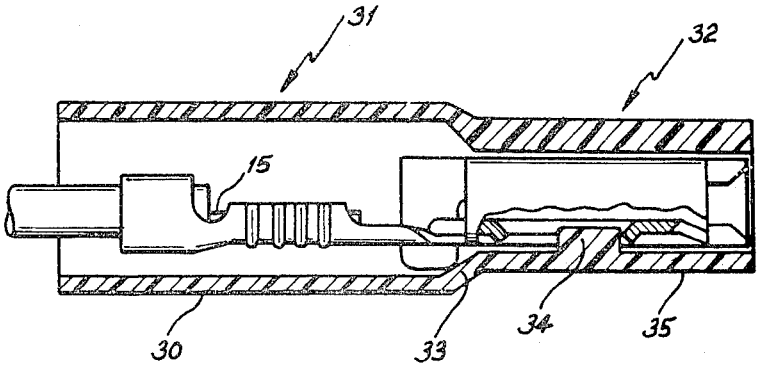
FIG. 6 is a partially sectioned, longitudinal elevation of the connector in the form shown in FIG. 4 when positioned within a co-operating insulating housing.

The rearward portion 12 is of generally U-shaped channel form before it is connected to a cable (as illustrated in FIG. 6) in a crimping operation. The rearward portion has a pair of ears 13 adapted to be crimped over to grip the insulating cover of a cable and a serrated channel section 14 adapted to be crimped over the exposed electrical conductor 15 as shown in FIG. 6.

Figure 5:
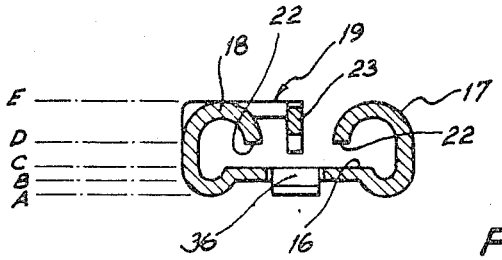
FIG. 5 is a transverse cross sectional elevation taken along the line V—V of FIG. 4.

The forward portion 11 might be best understood by comparing FIGS. 3 and 5. For convenience the receptacle will be described as orientated in FIG. 5 with the base 16 of the receptacle lowermost. FIG. 3 shows the upper surface of the base.

The metal blank of FIG. 3 has laterally projecting side portions cut to provide a long side wall 17 and a short side wall 18 with a generally "h-shaped" member 19 straddling over the portion providing the short side wall 18 and adapted to be bent to provide an engagement member having a latching shoulder 20 and a depressable release projection 21. The central region of the base is apertured for purposes described below.

As best seen from FIG. 5, the outer edge portions of the base 16 are bent downwardly and merge with side walls which are bent upwardly in a general C-shape, the side walls being turned inwardly over the base to provide free side edges 22 in spaced confronting relationship with the upper surface of the base in its central region. Similarly the "h-shaped" member 19 is bent over to provide a spine 23 which extends on edge downwardly between the side walls 17 and 18 towards the base, the latching shoulder 20 being directed downwardly and the projection 21 extending through a corresponding aperture 24.

Thus, as shown in FIG. 5, the forward portion 11 of the receptacle has a base plane A, a lower plane B containing the lower surface of the central region of the base, a plane C containing the upper surface of the central region of the base 16, an upper plane D containing the exposed edges of the turned in walls 17 and 18 and a top plane E. It will be noted that the tip of the latching shoulder 20 is intermediate the planes C and D.

The thickness of the tab to be received is substantially equal to the spacing between the planes C and D so that a firm fit is established. The tab has a central aperture for receiving the latching shoulder 20 whereby the tab is retained and electrical contact is established between the tab, the base 16 and the edges 22 of the turned-in walls 17 and 18. To facilitate insertion of the tab, the central region of the base at its end is bent downwardly as shown at 25 on opposite sides of an end slot 26 (FIG. 3).

FIG. 2 illustrates with dotted lines the central region 40 of the base 16 which is raised and provides a surface for mechanical and electrical contact with a tab. The tab is rectangular and when fully inserted comes into engagement with the end of the projection 21.

To release the tab, the projection 21 is simply pressed upwardly to lift the shoulder 20 so that the tab may be pulled free.

FIG. 3 also illustrates the manufacture of the cut blanks which are attached to a spine 27 by a frangible neck 28 from which the receptacle is broken after being attached to an electrical cable.

Figure 4:
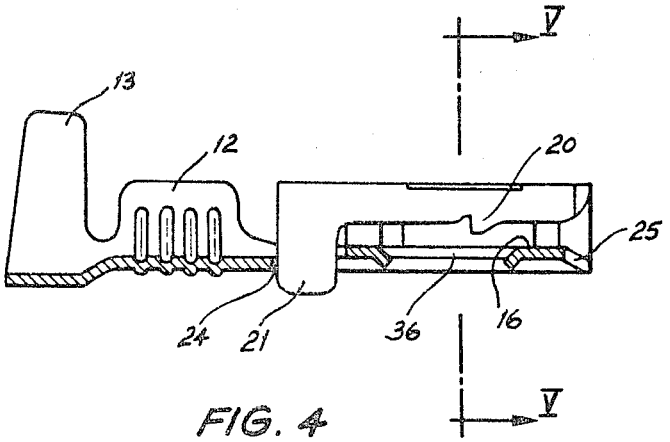
FIG. 4 is a sectional elevation of the connector of FIGS. 1 and 2 as taken along the lines IV—IV of FIG. 2.

In some cases it is desirable to house the receptacle within an insulating housing and in a preferred embodiment of the invention this is accomplished as shown in FIG. 6. The housing 30 is generally cylindrical having a larger rear portion 31 and a narrower forward portion 32 with a cam like ramp 33 interconnecting these portions. The receptacle is retained within the housing by virtue of an integrally moulded projection 34 extending with the housing from a substantially flat base 35 of the housing, the projection being of shorter longitudinal extent than a rectangular opening 36 in the centre of the base 16. It will be noted that the wall at each end of the aperture 36 is depressed downwardly (see FIGS. 4 and 5) so that its tip lies substantially in the lower plane A. The height of the projection 34, however, places its top surface midway between planes B and C and thus the projection does not intrude into the zone for receiving the tab but the receptacle is retained within the housing but with limited longitudinal movement.

FIG. 6 shows that a rounded corner of the projection 21 is normally located on the ramp 33 so that longitudinal movement of the housing displaces the projection upwardly to lift the latching shoulder 20, clearance being provided within the housing to permit the engagement element to lift.

With the shape and dimensions illustrated in the drawings, the engagement member will be relatively stiff but if a more easily released engagement member having greater resilience is desired this can be achieved by making the left hand base leg of the H-shaped member 19 narrower than the right hand base leg, when viewed as in FIG. 3. Indeed with advantage the right hand leg is increased in width by the same amount that the left hand leg is reduced in width.

In a second embodiment of the invention even greater resilience in the engagement member is provided by altering the engagement member by omitting the portion marked 19*a* in FIGS. 2 and 3.

I claim:

1. (a) An electrical tab receptacle integrally formed from a single piece of sheet metal and comprising a forward portion and a rearward portion, (b) the rearward portion being adapted to be connected to an electrical conductor and the forward portion having a generally channel-shaped receptacle portion for engaging in mating relationship with a complementary tab, (c) the receptacle portion having a base and upstanding side walls which are turned in so as to have free edge portions in spaced confronting relation with the base, the arrangement being such that the tab is adapted to be received between said free edge portions and the base to form a connection, and characterised by (d) the tab receptacle further comprising a resiliently displaceable engagement member extending from a side of the receptacle portion and a portion of the engagement member extending between the turned in portions of the side walls in a direction towards the base to provide an engagement element for engaging in latching engagement with a corresponding portion of the complementary tab, (e) the engagement member having a release portion located outside the channel-shaped receptacle portion for receiving a displacement force to move the engagement element in a direction away from the base and towards the turned in portions of the side walls to permit disengagement of the engagement element from the complementary tab, and (f) the engagement element being biased to its latching position.

2. A tab receptacle according to claim 1, wherein said engagement member is connected to and extends from one side of the base at a position adjacent to that from which one of said side walls extends.

3. A tab receptacle according to claim 1 wherein said release portion takes the form of a projection which extends through an opening in the receptacle to terminate at a location which is on the opposite side of the base from said turned-in side walls and at a location to the rearward end of the zone occupied by the tab when inserted.

4. A tab receptacle according to claim 2, wherein said engagement member is generally "h-shaped" when flat and has base legs extending from the side of the base at respective ends of one of said side walls, said engagement element being formed in the cross arm of the "h", and the top leg of the "h" providing the release portion and being adjacent the base leg which is nearer said rearward portion.

5. A tab receptacle according to claim 4, wherein said turned-in side wall around which the "h-shaped" member is located is of shorter length than the opposite side wall, the opposite side wall having approximately the same length as the overall longitudinal span from base leg to base leg of the "h-shaped" member.

6. A tab receptacle according to claim 4, wherein said "h-shaped" member has its top leg forming the release portion and this is offset relative to the adjacent base leg towards the rearward end of the receptacle thereby forming a stop for the tab just beyond the rearward limit at the turned-in side walls.

7. A tab receptacle according to claim 1, wherein said receptacle is longitudinally elongated and wherein the engagement member has a first leg extending from the base at the forward end thereof, a cross arm extending from the first leg along the longitudinal direction of the receptacle, the engagement element depending from the cross arm, and a second leg connected to the cross arm and having the release portion extending therefrom.

8. A tab receptacle according to claim 7, wherein said release portion takes the form of a projection which extends through an opening in the receptacle to terminate at a location which is on the opposite side of the base from the turned in side walls and at a location to the rearward end of the zone occupied by the tab when inserted.

9. In combination, a tab receptacle as claimed in claim 1 and a tubular insulating housing having means cooperating with the receptacle to retain the receptacle within the housing.

10. The combination according to claim 9, wherein the base of the receptacle has an aperture in the central region of the base, and the insulating housing has an inwardly directed projection arranged to snap fit into the aperture in the base to retain the receptacle.

11. The combination according to claim 10, wherein said aperture is rectangular with its ends formed by inclined walls projecting below the general plane of the base and the portion surrounding the aperture, but not extending below a plane containing the lowermost extremity provided in the region of the sides of the base and/or the bottom of the side walls.

12. The combination according to any one of claims 9, 11, wherein said housing includes a cam surface normally positioned adjacent said release portion of the tab receptacle, the housing and tab receptacle being relatively displaceable in a direction extending along the tab receptacle from said forward portion to said rearward portion, and said cam surface being shaped and positioned to displace said release portion under said relative displacement of the tab receptacle and housing, whereby said engagement member is displaced for releasing a tab connector.

* * * * *